US009263169B2

(12) United States Patent
Lee et al.

(10) Patent No.: US 9,263,169 B2
(45) Date of Patent: Feb. 16, 2016

(54) ALUMINUM PASTE AND SOLAR CELL

(75) Inventors: Byung Chul Lee, Uiwang-si (KR); Dong Suk Kim, Uiwang-si (KR); Jae Ho Kim, Uiwang-si (KR); Jae Hwan Oh, Uiwang-si (KR); Hyun Don Kim, Uiwang-si (KR)

(73) Assignee: CHEIL INDUSTRIES, INC., Gumi-si, Kyeongsangbuk-do (KR)

( * ) Notice: Subject to any disclaimer, the term of this patent is extended or adjusted under 35 U.S.C. 154(b) by 55 days.

(21) Appl. No.: 13/041,826

(22) Filed: Mar. 7, 2011

(65) Prior Publication Data

US 2012/0037855 A1 Feb. 16, 2012

(30) Foreign Application Priority Data

Aug. 12, 2010 (KR) ..... 10-2010-0077786

(51) Int. Cl.
*H01B 1/02* (2006.01)
*H01B 1/22* (2006.01)

(52) U.S. Cl.
CPC ..... *H01B 1/22* (2013.01)

(58) Field of Classification Search
USPC ..... 136/261, 252; 252/512, 518.1, 519
See application file for complete search history.

(56) References Cited

U.S. PATENT DOCUMENTS

| | | | | |
|---|---|---|---|---|
| 2006/0001009 | A1 | 1/2006 | Garreau-Iles et al. | |
| 2007/0079868 | A1 | 4/2007 | Rose et al. | |
| 2009/0056798 | A1 * | 3/2009 | Merchant et al. | 136/256 |
| 2009/0229665 | A1 | 9/2009 | Young et al. | |
| 2009/0255583 | A1 | 10/2009 | Young et al. | |
| 2011/0120535 | A1 * | 5/2011 | Prince et al. | 136/252 |

FOREIGN PATENT DOCUMENTS

| | | | |
|---|---|---|---|
| CN | 101295739 | * | 10/2008 |
| CN | 101752459 | | 6/2010 |
| EP | 1775776 | A1 | 4/2007 |
| JP | 02213432 | * | 8/1990 |
| JP | 2008-520094 | A | 6/2008 |
| JP | 2010-83748 | A | 4/2010 |
| KR | 10 2007-0040308 | A | 4/2007 |

OTHER PUBLICATIONS

European Search Report in EP 10196589.5-1218, dated Nov. 3, 2011 (Lee, et al.).
Chinese Office Action dated Dec. 25, 2012, with English Translation.

* cited by examiner

*Primary Examiner* — Monique Peets
(74) *Attorney, Agent, or Firm* — Lee & Morse, P.C.

(57) ABSTRACT

An aluminum paste and a solar cell, the aluminum paste including aluminum powder; an organic vehicle; and antimony oxide, the antimony oxide being present in an amount of about 0.001 wt % to less than about 1.0 wt %, based on a total weight of the aluminum paste.

16 Claims, 1 Drawing Sheet

ALUMINUM PASTE AND SOLAR CELL

BACKGROUND

1. Field

Embodiments relate to an aluminum paste and a solar cell using the same.

2. Description of the Related Art

Fossil fuels, e.g., oil and coal, are not renewable. Thus, solar cells utilizing sunlight as an alternative energy source have attracted attention. A solar cell may employ a semiconductor device that directly converts sunlight energy into electricity. The semiconductor device may be fabricated using silicon materials.

SUMMARY

Embodiments are directed to an aluminum paste and a solar cell using the same.

The embodiments may be realized by providing an aluminum paste including aluminum powder; an organic vehicle; and antimony oxide, the antimony oxide being present in an amount of about 0.001 wt % to less than about 1.0 wt %, based on a total weight of the aluminum paste.

The antimony oxide may include at least one of $Sb_2O_3$, $Sb_2O_4$, and $Sb_2O_5$.

The antimony oxide may include antimony oxide powder having an average particle size of about 0.01 μm to about 10 μm.

The antimony oxide may be in the form of a spherical powder.

The aluminum powder may be present in an amount of about 60 to about 80 wt %, based on the total weight of the aluminum paste.

The aluminum powder may have an average particle size of about 0.1 μm to about 10 μm.

The organic vehicle may be present in an amount of about 0.1 to about 40 wt %, based on the total weight of the aluminum paste.

The organic vehicle may include at least one of an acrylic binder resin and a cellulose binder resin.

The organic vehicle may include a solvent, the solvent including at least one of hexane, toluene, ethyl cellosolve, cyclo hexanone, butyl cellosolve, butyl carbitol (diethylene glycol monobutyl ether), dibutyl carbitol (diethylene glycol dibutyl ether), butyl carbitol acetate (diethylene glycol monobutyl ether acetate), propylene glycol monomethyl ether, hexane glycol, terpineol, methylethylketone, benzylalcohol, gamma-butyrolactone, and ethyl lactate.

The aluminum paste may further include a glass frit.

The glass frit may be present in an amount of about 0.01 to about 20 wt %, based on the total weight of the aluminum paste.

The glass frit may include at least one of zinc oxide-silicon oxide ($ZnO—SiO_2$), zinc oxide-boron oxide-silicon oxide ($ZnO—B_2O_3—SiO_2$), zinc oxide-boron oxide-silicon oxide-aluminum oxide ($ZnO—B_2O_3—SiO_2—Al_2O_3$), bismuth oxide-silicon oxide ($Bi_2O_3—SiO_2$), bismuth oxide-boron oxide-silicon oxide ($Bi_2O_3—B_2O_3—SiO_2$), bismuth oxide-boron oxide-silicon oxide-aluminum oxide ($Bi_2O_3—B_2O_3—SiO_2—Al_2O_3$), bismuth oxide-zinc oxide-boron oxide-silicon oxide ($Bi_2O_3—ZnO—B_2O_3—SiO_2$), and bismuth oxide-zinc oxide-boron oxide-silicon oxide-aluminum oxide ($Bi_2O_3—ZnO—B_2O_3—SiO_2—Al_2O_3$) glass frits.

The aluminum paste may further include a dispersant.

The dispersant may include at least one of stearic acid, palmitic acid, myristic acid, oleic acid, and lauric acid.

The antimony oxide may be present in an amount of about 0.001 wt % to about 0.75 wt %, based on the total weight of the aluminum paste.

The embodiments may also be realized by providing a solar cell including a rear electrode prepared from the aluminum paste of an embodiment.

The embodiments may also be realized by providing a solar cell including a rear electrode, the rear electrode including about 0.001 wt % to less than about 1.30 wt % of antimony oxide, based on a total weight of the rear electrode.

The antimony oxide may be present in an amount of about 0.001 wt % to about 1.0 wt %, based on the total weight of the rear electrode.

BRIEF DESCRIPTION OF THE DRAWINGS

The embodiments will become more apparent to those of ordinary skill in the art by describing in detail exemplary embodiments with reference to the attached drawings, in which.

DETAILED DESCRIPTION

Figure 1:
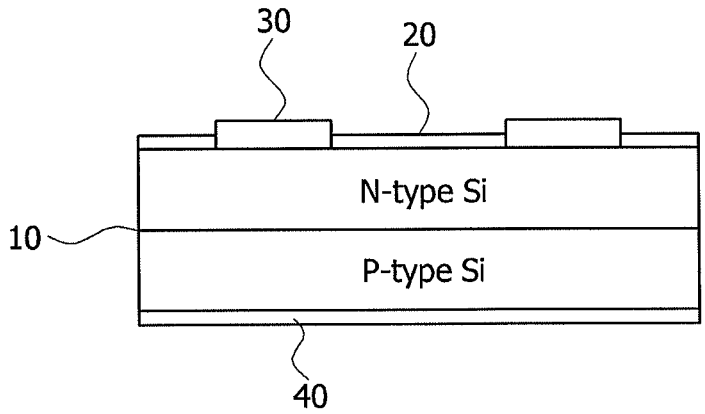
FIG. 1 illustrates a sectional view of a solar cell.

Korean Patent Application No. 10-2010-0077786, filed on Aug. 12, 2010, in the Korean Intellectual Property Office, and entitled: "Aluminum Paste and Solar Cell Using the Same," is incorporated by reference herein in its entirety.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the invention to those skilled in the art.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. In addition, it will also be understood that when a layer is referred to as being "between" two layers, it can be the only layer between the two layers, or one or more intervening layers may also be present. Like reference numerals refer to like elements throughout.

FIG. 1 illustrates a sectional view of a solar cell. As shown in FIG. 1, the solar cell may include a silicon wafer 10 having a p-n junction structure, an antireflection film 20 on an upper surface of the silicon wafer 10 (the antireflection film 20 facilitating efficient absorption of light into the solar cell), and front and rear electrodes 30, 40 respectively printed on upper and lower surfaces of the silicon wafer 10 (to extract electricity from the silicon wafer 10).

The front electrode 30 may be formed from a silver (Ag) paste; and the rear electrode 40 may be formed from an aluminum (Al) paste. Such a structure may improve photoelectric conversion efficiency.

Alternatively, instead of forming the antireflection film on the silicon wafer, the silicon wafer may be subjected to surface roughening to reduce reflection of sunlight entering the silicon wafer.

In a solar cell having the above described configuration, when sunlight is absorbed into the silicon wafer, electrons (−) and holes (+) may be generated therein by the absorbed light.

The generated electrons (−) and holes (+) may be separated from each other by a potential difference in the p-n junction between a p-region and an n-region in the wafer so that the electrons may move towards the n-region and the holes may move towards the p-region. Thus, the electrons (−) and the holes (+) may be collected by the front electrode and the rear electrode, respectively. Accordingly, the rear electrode may be a positive electrode and the front electrode may be a negative electrode to supply electricity. The rear electrode of the solar cell may be prepared by printing the aluminum paste on a silicon wafer, followed by sintering and modulation.

The embodiments provide an aluminum paste including antimony oxide and solar cells formed using the same. The aluminum paste may include aluminum powder, antimony oxide, and an organic vehicle. In an implementation, the aluminum paste may include aluminum powder, antimony oxide, an organic vehicle, a glass frit, a dispersant, and the like. The aluminum paste may be used to form an electrode of the solar cell.

Aluminum Powder

The aluminum powder may have a nanometer scale or micron scale particle size. For example, the aluminum powder may have a particle size of dozens to several hundred nanometers or several to dozens of microns. The aluminum powder may include a mixture of aluminum powders having two or more different particle sizes.

The aluminum powder may be present in an amount of about 40 to about 90 wt %, and preferably about 60 to about 80 wt %, based on a total weight of the aluminum paste. However, the embodiments are not limited thereto. Maintaining the amount of the aluminum powder at about 40 to about 90 wt % may help improve printability and physical adhesive strength while lowering inherent resistance of the electrode formed from the aluminum paste.

The aluminum powder may be in the form of a spherical powder. However, the embodiments are not limited thereto; and the aluminum powder may have a variety of shapes, e.g., a flake shape or an amorphous shape.

The aluminum powder may have an average particle size of about 0.01 μm to about 20 μm, preferably about 0.1 μm to about 10 μm, and more preferably about 1 μm to about 5 μm, but is not limited thereto.

The particle size of the aluminum powders may be measured by a particle size measuring device, e.g., Model 1064D (CILAS Co., Ltd.). The measurement of the particle size may be conducted after dispersing the aluminum powders in, e.g., isopropyl alcohol (IPA) as a solvent, with ultrasound waves at room temperature for about 3 minutes. Herein, the measurement methods of particle sizes of the antimony oxide powder and glass frit are the same as that of the aluminum powders.

The aluminum powder may include other metallic components. For example, the aluminum powder may include gold, silver, copper, and the like. In an implementation, the aluminum powder may include alloy powders containing aluminum.

The aluminum powder may include aluminum sprayed in air or in an inert state. The aluminum powder may also be prepared by a pulsed wire evaporation method.

Antimony Oxide

When the antimony oxide is present in a suitable amount in the aluminum paste, it is possible to achieve effective prevention of a bowing phenomenon. The antimony oxide may be present in an amount of about 0.001 wt % to less than about 1.0 wt %, based on the total weight of the aluminum paste. Maintaining the amount of the antimony oxide within this range may help ensure that the aluminum paste is capable of noticeably preventing the bowing phenomenon and suppressing generation of bubbles in a hot water test (which will be described in greater detail below). In an implementation, the antimony oxide may be present in an amount of about 0.001 wt % to about 0.75 wt %, based on a total weight of the aluminum paste.

The antimony oxide may include at least one of antimony (III) trioxide ($Sb_2O_3$), antimony(IV) tetroxide ($Sb_2O_4$), and antimony(V) pentoxide ($Sb_2O_5$). Antimony(III) trioxide may be produced by sublimation of antimony or antimony sulfide by burning in air, (or by dissolving antimony in sulfuric acid or nitric acid), followed by heating and hydrolysis in a dilute alkali solution. Antimony(IV) tetroxide may exist as a mineral cervantite in nature. Antimony(IV) tetroxide may be produced by heating antimony(III) trioxide or antimony(V) pentoxide in air. Antimony(V) pentoxide may be produced through oxidation of antimony or other antimony oxides.

The antimony oxide may be in the form of a spherical powder, but is not limited thereto. In an implementation, the antimony oxide powder may be a spherical powder having an average particle size of about 0.01 μm to about 10 μm. Maintaining the particle size of the antimony oxide powder within this range may help ensure that the antimony oxide provides improvement in printability of the aluminum paste and processability while facilitating easy adjustment of viscosity. In another embodiment, the antimony oxide powder may be a spherical powder having an average particle size of about 0.01 μm to about 5 μm, and preferably about 0.1 to about 5 μm.

Organic Vehicle

The organic vehicle may provide suitable viscosity and rheologocal properties to the aluminum paste for printing through mechanical mixing with the organic components of the aluminum paste.

In an implementation, the organic vehicle may be an organic vehicle suitable for use in pastes for solar cell electrodes. The organic vehicle may include a binder resin and/or a solvent. The organic vehicle may further include a thixotropic agent and the like.

The binder resin may include, e.g., acrylic resins or cellulose resins. In an implementation, ethyl cellulose may be used as the binder resin. In another implementation, the binder resin may include at least one of ethyl hydroxyethylcellulose, nitrocellulose, a mixture of ethyl cellulose and a phenol resin, alkyd resins, phenolic resins, acrylic acid ester resins, xylenol resins, polybutene resins, polyester resins, urea resins, melamine resins, vinyl acetate resins, wood rosin, and polymethacrylate.

The solvent may include, but is not limited to, hexane, toluene, ethyl cellosolve, cyclohexanone, butyl cellosolve, butyl carbitol (diethylene glycol monobutyl ether), dibutyl carbitol (diethylene glycol dibutyl ether), butyl carbitol acetate (diethylene glycol monobutyl ether acetate), propylene glycol monomethyl ether, hexane glycol, terpineol, methylethylketone, benzylalcohol, gamma-butyrolactone, and ethyl lactate.

The organic vehicle may be included in an amount of about 0.1 to about 40 wt %, preferably about 1 to about 30 wt %, and more preferably about 5 to about 30 wt %, based on the total weight of the paste. Maintaining the amount of the organic vehicle at about 0.1 to about 40 wt % may help ensure that the aluminum paste exhibits sufficient adhesive strength and good printability.

Glass Frit

The glass frit may include at least one of a leaded glass frit and a lead-free glass frit. For example, the glass frit may include at least one of zinc oxide-silicon oxide ($ZnO—SiO_2$), zinc oxide-boron oxide-silicon oxide ($ZnO—B_2O_3—SiO_2$), zinc oxide-boron oxide-silicon oxide-aluminum oxide ($ZnO—B_2O_3—SiO_2—Al_2O_3$), bismuth oxide-silicon oxide ($Bi_2O_3—SiO_2$), bismuth oxide-boron oxide-silicon oxide ($Bi_2O_3—B_2O_3—SiO_2$), bismuth oxide-boron oxide-silicon oxide-aluminum oxide ($Bi_2O_3—B_2O_3—SiO_2—Al_2O_3$), bismuth oxide-zinc oxide-boron oxide-silicon oxide ($Bi_2O_3—ZnO—B_2O_3—SiO_2$), and bismuth oxide-zinc oxide-boron oxide-silicon oxide-aluminum oxide ($Bi_2O_3—ZnO—B_2O_3—SiO_2—Al_2O_3$) glass frits.

The glass frit is not limited to a particular shape and may have, e.g., a spherical or amorphous shape. The glass frit may have an average particle size of about 0.1 μm to about 10 μm, but is not limited thereto. The glass frit may be present in an amount of about 0.01 to about 20 wt %, preferably about 0.01 to about 10 wt %, and more preferably about 0.1 to about 5 wt %, based on the total weight of the aluminum paste. In an implementation, the glass fit may be omitted from the aluminum paste.

The glass frit may include commercially available glass frit. In an implementation, the glass frit may be prepared by selectively dissolving, e.g., silicon dioxide ($SiO_2$), aluminum oxide ($Al_2O_3$), boron oxide ($B_2O_3$), bismuth oxide ($Bi_2O_3$), sodium oxide ($Na_2O$), zinc oxide (ZnO), cadmium oxide (CdO), barium oxide (BaO), lithium oxide ($Li_2O$), lead oxide (PbO), and/or calcium oxide (CaO), to provide a desired composition. For example, the composition obtained by dissolving the oxide may be added to water to prepare the glass frit.

Dispersant

In an implementation, the aluminum paste may further include a dispersant. The dispersant may include, but is not limited to, stearic acid, palmitic acid, myristic acid, oleic acid, and lauric acid. The dispersant may be used alone or in a combination of two or more thereof. The dispersant may be present in an amount of about 0.01 to about 5 wt % and preferably about 0.1 to about 5 wt %, based on the total weight of the aluminum paste. Maintaining the amount of the dispersant at about 0.01 to about 5 wt % may help ensure that the aluminum paste exhibits excellent dispersibility while preventing an increase in inherent resistance of the electrode (formed from the aluminum paste) during sintering.

Other Additives

In an implementation, the paste may further include additives, e.g., a stabilizer, an anti-oxidant, a silane coupling agent, a viscosity controlling agent, etc. The other additives may be included in an amount so as not to inhibit advantageous effects of the aluminum paste according of the embodiments.

Figure 2:
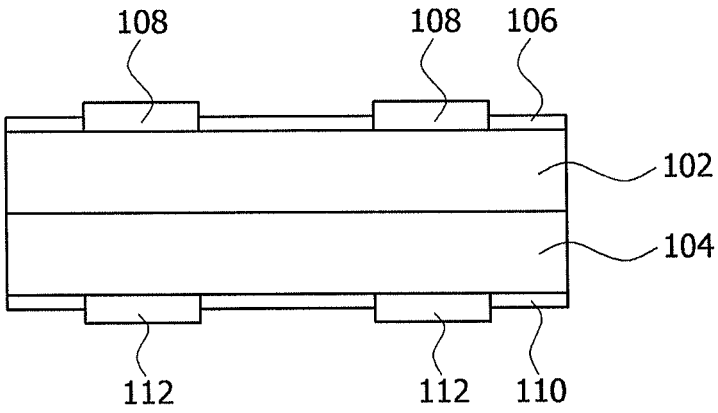
FIG. 2 illustrates a sectional view of a solar cell including a rear electrode formed from an aluminum paste according to an embodiment.

FIG. 2 illustrates a sectional view of a solar cell including a rear electrode formed using an aluminum paste according to an embodiment. The solar cell may be formed of, e.g., a single crystal silicon, polycrystalline silicon, or thin film silicon wafer.

When the solar cell is formed of the single crystal silicon wafer, a Czochralski method may be employed to form the silicon wafer. When the solar cell is formed of the polycrystalline silicon wafer, a casting method may be employed to form the silicon wafer. For example, a silicon ingot formed by the Czochralski method or the casting method may be sliced to a predetermined thickness (e.g., 100 μm), followed by etching with NaOH, KOH, fluoric acid, or the like to provide a clean surface to the silicon wafer.

For a P-type wafer, an N-layer 102 may be formed by diffusing a pentavalent element, e.g., phosphorous (P), thereinto, in which a depth of a diffusion layer may be determined by controlling diffusion temperature, time, and the like. For example, the N-layer 102 may be formed by thermal diffusion (in which $P_2O_5$ is applied to the silicon wafer and diffused thereon by heat), vapor phase thermal diffusion (in which vaporized $POCl_3$ is used as a diffusion source), ion implantation (in which $P^+$ ions are directly implanted into the silicon wafer), and the like.

Then, an antireflection film 106 may be formed on the N-layer 102. The antireflection film 106 may increase a photo-absorption rate by reducing reflectivity of light incident on a surface of the solar cell, thereby increasing generation of electric current.

The antireflection film 106 may be formed as a single layer or multi-layer including at least one of $SiN_x$, $TiO_2$, $SiO_2$, MgO, ITO, $SnO_2$, and ZnO. The antireflection film 106 may be formed by a thin-film deposition process, e.g., sputtering, Chemical Vapor Deposition (CVD), and the like. For example, when coating a $SiN_x$ film via heat CVD, dichlorosilane ($SiCl_2H_2$) and ammonia ($NH_3$) gases may be used as starting materials; and the film may typically be formed at a temperature of about 700° C. or more.

A front electrode 108 may be formed on the antireflection film 106. The front electrode 108 may be formed by depositing silver (Ag) paste by, e.g., screen printing or the like. The silver paste deposited on the antireflection film 106 may be connected to the N-layer 102 through the antireflection film during sintering.

A rear electrode 110 may be formed (using the aluminum paste of an embodiment) on a backside of the solar cell, e.g., on a lower surface of a P-layer 104. To prepare the aluminum paste for the rear electrode, a resin solution may first be prepared; and a pre-mixture of the aluminum powder and the glass frit may be prepared and then dispersed in the resin solution by milling.

The prepared aluminum paste may be deposited (e.g., printed) on the lower surface of the P-layer 104, followed by drying and sintering, thereby completing fabrication of the rear electrode 110. Thus, the rear electrode may include about 0.001 wt % to less than about 1.30 wt % of the antimony oxide, based on a total weight of the rear electrode. In an implementation, rear electrode may include about 0.001 wt % to less than about 1.0 wt % of the antimony oxide, based on a total weight of the rear electrode.

While sintering during formation of the rear electrode 110, a back surface field (BSF) layer may be formed on the rear electrode. A process of forming the BSF layer may be conducted before the rear electrode 110 is formed. The BSF layer may refer to a region on a back side of the silicon wafer, in which a conductive type semiconductor impurity is diffused at high density, and may prevent deterioration in photoelectric conversion efficiency by recombination of carriers. For example, the BSF layer may be separately formed at about 800 to about 1000° C. through thermal diffusion (which employs $BBr_3$ as a diffusion source).

An aluminum electrode cannot be easily soldered. Thus, a bus bar electrode 112 may be formed in order to establish an electrical connection. The bus bar electrode 112 may be formed through, e.g., deposition and sintering of a silver paste (which may include silver powder, an organic vehicle, glass frit, and the like). In an implementation, the bus bar electrode 112 may be formed through, e.g., deposition and sintering of a silver-aluminum paste (which may include silver powder, aluminum powder, an organic vehicle, glass fit, and the like).

EXAMPLES

The following Examples, Comparative Examples (C.E.), and experiments are given for illustrative purposes only and are not intended to limit the scope of this disclosure. Moreover, the Comparative Examples are set forth to highlight certain characteristics of certain embodiments and are not to be construed as either limiting the scope of the invention as exemplified in the Examples or as necessarily always being outside the scope of the invention in every respect.

In Tables 1 and 2, below, Aluminum powder 1 was 3 μm aluminum powder (Goldsky Co., Ltd.) and Aluminum powder 2 was 4 μm aluminum powder (Jinmao Co., Ltd.). Amounts of each component are % by weight based on the total weight of the aluminum paste.

TABLE 1

| Composition | Example 1 | Example 2 | Example 3 | Example 4 | Example 5 |
|---|---|---|---|---|---|
| Aluminum powder 1 | 74 | — | — | 74 | — |
| Aluminum powder 2 | — | 74 | 74 | — | 74 |
| Organic vehicle | 24 | 24.25 | 23.75 | 23 | 23 |
| Leaded glass frit | 1 | — | — | 2 | — |
| Lead-free glass frit | — | 1 | 1 | — | 2 |
| Dispersant | 0.5 | 0.5 | 0.5 | 0.5 | 0.5 |
| Antimony oxide | 0.5 | 0.25 | 0.75 | 0.5 | 0.5 |
| Total (wt %) | 100 | 100 | 100 | 100 | 100 |

TABLE 2

| Composition | C.E. 1 | C.E. 2 | C.E. 3 | C.E. 4 | C.E. 5 | C.E. 6 | C.E. 7 | C.E. 8 |
|---|---|---|---|---|---|---|---|---|
| Aluminum powder 1 | 74 | 74 | — | — | 74 | — | 74 | 74 |
| Aluminum powder 2 | — | — | 74 | 74 | — | 74 | — | — |
| Organic vehicle | 24.5 | 24 | 24.5 | 24 | 23.5 | 23.5 | 22.5 | 22 |
| Leaded glass frit | 1 | 1.5 | — | — | 2 | 2 | 2 | 2 |
| Lead-free glass frit | — | — | 1 | 1.5 | — | — | — | — |
| Dispersant | 0.5 | 0.5 | 0.5 | 0.5 | 0.5 | 0.5 | 0.5 | 0.5 |
| Antimony oxide | — | — | — | — | — | — | 1.0 | 1.5 |
| Total (wt %) | 100 | 100 | 100 | 100 | 100 | 100 | 100 | 100 |

Example 1

An organic vehicle was prepared by sufficiently dissolving ethyl cellulose (STD20, Dow Chemical Company) in terpineol (Fujian QingLiu Minshan Chemical Co., Ltd.) and butyl carbitol acetate BCA (Samchun Chemical Co., Ltd.) in a weight ratio of 1:4.5:4.5 (ethyl cellulose:terpineol:BCA). Then, 0.5 wt % of a dispersant (BYK111, BYK-Chemie), 1.0 wt % of a leaded glass frit (CI-05, Particlogy Co., Ltd.), 0.5 wt % of antimony oxide ($Sb_2O_3$, antimony(III) oxide, 98.0% (T), Samchun Chemical Co., Ltd.), and 74 wt % of 3 μm Al powder (Goldsky Co., Ltd.) were mixed in 24 wt % of the organic vehicle. Then, the mixture was dispersed for 3 hours using a dispersing tool (Dispermat) at 3,000 rpm, thereby preparing the paste of Example 1.

Example 2

The aluminum paste of Example 2 was prepared by the same method as in Example 1, except that 0.5 wt % of a dispersant (BYK111, BYK-Chemie), 1.0 wt % of a lead-free glass frit (BF-403D2, Particlogy Co., Ltd.), 0.25 wt % of antimony oxide ($Sb_2O_3$, antimony(III) oxide, 98.0% (T), Samchun Chemical Co., Ltd.), and 74 wt % of 4 μm Al powder (Jinmao Co., Ltd.) were mixed in 24.25 wt % of the organic vehicle of Example 1.

Example 3

The aluminum paste of Example 3 was prepared by the same method as in Example 1, except that 0.5 wt % of a dispersant (BYK111, BYK-Chemie), 1.0 wt % of a lead-free glass frit (BF-403D2, Particlogy Co., Ltd.), 0.75 wt % of antimony oxide ($Sb_2O_3$, antimony(III) oxide, 98.0% (T), Samchun Chemical Co., Ltd.), and 74 wt % of 4 μm Al powder (Jinmao Co., Ltd.) were mixed in 23.75 wt % of the organic vehicle of Example 1.

Example 4

The aluminum paste of Example 4 was prepared by the same method as in Example 1, except that 0.5 wt % of a dispersant (BYK111, BYK-Chemie), 2 wt % of a leaded glass frit (CI-05, Particlogy Co., Ltd.), 0.5 wt % of antimony oxide ($Sb_2O_3$, antimony(III) oxide, 98.0% (T), Samchun Chemical Co., Ltd.), and 74 wt % of 3 μm Al powder (Goldsky Co., Ltd.) were mixed in 23 wt % of the organic vehicle of Example 1.

Example 5

The aluminum paste of Example 5 was prepared by the same method as in Example 1, except that 0.5 wt % of a dispersant (BYK111, BYK-Chemie), 2 wt % of a lead-free glass fit (BF-403D2, Particlogy Co., Ltd.), 0.5 wt % of antimony oxide ($Sb_2O_3$, antimony(III) oxide, 98.0% (T), Samchun Chemical Co., Ltd.), and 74 wt % of 4 μm Al powder (Jinmao Co., Ltd.) were mixed in 23 wt % of the organic vehicle of Example 1.

Comparative Example 1

The aluminum paste of Comparative Example 1 was prepared by the same method as in Example 1, except that the antimony oxide ($Sb_2O_3$, antimony(III) oxide, 98.0% (T), Samchun Chemical Co., Ltd.) was omitted and the organic vehicle of Example 1 was provided in an amount of 24.5 wt %.

Comparative Example 2

The aluminum paste of Comparative Example 2 was prepared by the same method as in Example 1, except that the antimony oxide ($Sb_2O_3$, antimony(III) oxide, 98.0% (T), Samchun Chemical Co., Ltd.) was omitted and the leaded glass frit (CI-05, Particlogy Co., Ltd.) of Example 1 was provided in an amount of 1.5 wt %.

Comparative Example 3

The aluminum paste of Comparative Example 3 was prepared by the same method as in Example 2, except that the antimony oxide ($Sb_2O_3$, antimony(III) oxide, 98.0% (T), Samchun Chemical Co., Ltd.) was omitted and the organic vehicle of Example 2 was provided in an amount of 24.5 wt %.

Comparative Example 4

The paste of Comparative Example 4 was prepared by the same method as in Example 2, except that the antimony oxide ($Sb_2O_3$, antimony(III) oxide, 98.0% (T), Samchun Chemical Co., Ltd.) was omitted and the lead-free glass frit (BF-403D2, Particlogy Co., Ltd.) of Example 2 was provided in an amount of 1.5 wt %.

Comparative Example 5

The paste of Comparative Example 5 was prepared by the same method as in Example 4, except that the antimony oxide ($Sb_2O_3$, antimony(III) oxide, 98.0% (T), Samchun Chemical Co., Ltd.) was omitted and the organic vehicle of Example 4 was provided in an amount of 23.5 wt %.

Comparative Example 6

The paste of Comparative Example 6 was prepared by the same method as in Example 5, except that the antimony oxide ($Sb_2O_3$, antimony(III) oxide, 98.0% (T), Samchun Chemical Co., Ltd.) was omitted and the organic vehicle of Example 5 was provided in an amount of 23.5 wt %.

Comparative Example 7

The paste of Comparative Example 7 was prepared by the same method as in Example 1, except that 0.5 wt % of a dispersant (BYK111, BYK-Chemie), 2.0 wt % of a leaded glass fit (CI-05, Particlogy Co., Ltd.), 1.0 wt % of antimony oxide ($Sb_2O_3$, antimony(III) oxide, 98.0% (T), Samchun Chemical Co., Ltd.), and 74 wt % of 3 μm Al powder (Goldsky Co., Ltd.) were mixed in 22.5 wt % of the organic vehicle of Example 1.

Comparative Example 8

The paste of Comparative Example 8 was prepared by the same method as in Example 1, except that 0.5 wt % of a dispersant (BYK111, BYK-Chemie), 2.0 wt % of a leaded glass fit (CI-05, Particlogy Co., Ltd.), 1.5 wt % of antimony oxide ($Sb_2O_3$, antimony(III) oxide, 98.0% (T), Samchun Chemical Co., Ltd.), and 74 wt % of 3 μm Al powder (Goldsky Co., Ltd.) were mixed in 22.0 wt % of the organic vehicle of Example 1.

Evaluation of Properties (1) Bowing: With a sintered solar cell placed on a flat bottom, a distance from a center to a highest point of the solar cell was defined as the degree of bowing.

(2) Bead generation: Generation of beads was determined by observing a backside of the sintered solar cell with the naked eye.

(3) Photoelectric conversion efficiency: In fabrication of the solar cell, a front electrode was formed using PA-SF8100 (Ag Paste, Cheil Industries Inc.). A BTU furnace for sintering was operated at a belt speed of 220 rpm with temperature zones set to Zone 1=500° C., Zone 2=550° C., Zone 3=650° C., Zone 4=730° C., Zone 5=820° C., and Zone 6=910° C. The sintered solar cell was tested using a cell tester obtained from PASAN SA.

(4) Hot water test: The solar cell was dipped into hot water at 70° C. before sintering; and it was observed whether bubbles were generated from the aluminum paste. When bubbles were generated from an Al paste sample, the sample was marked X and when the bubbles were not generated from the sample, the sample was marked O. In the hot water test, the generation of bubbles indicated that the electrode was highly reactive with moisture in air or had low stability, thereby causing deterioration in reliability of a solar cell module.

Each of the solar cells including rear electrodes formed using the aluminum pastes of the Examples and Comparative Examples was tested in terms of bowing, bead generation, photoelectric conversion efficiency and bubbling (hot water test). The results are shown in Table 3, below.

TABLE 3

| Composition | Bowing (mm) | Bead generation | Photoelectric conversion efficiency (%) | Hot water test |
|---|---|---|---|---|
| Example 1 | 1.5 | Not generated | 16.51 | ○ |
| Example 2 | 1.5 | Not generated | 16.64 | ○ |
| Example 3 | 1 | Not generated | 16.37 | ○ |
| Example 4 | 1.5 | Not generated | 16.21 | ○ |
| Example 5 | 1.5 | Not generated | 16.20 | ○ |
| C.E. 1 | 4 | Generated | 16.38 | ○ |
| C.E. 2 | 5 | Generated | 16.41 | ○ |
| C.E. 3 | 4 | Generated | 16.17 | ○ |
| C.E. 4 | 5.5 | Generated | 16.15 | ○ |
| C.E. 5 | 6.5 | Not generated | 16.03 | ○ |
| C.E. 6 | 6.5 | Not generated | 16.10 | ○ |
| C.E. 7 | 1 | Not generated | 16.23 | X |
| C.E. 8 | 1 | Not generated | 16.31 | X |

As shown in Table 3, in the solar cells of the Examples in which the aluminum pastes used to form the rear electrodes contained 0.25 wt %, 0.5 wt %, and 0.75 wt % of the antimony oxide, the degree of bowing was 1.5 mm or less. Such a degree of bowing was significantly less than the solar cells (of Comparative Examples 1-6) in which the aluminum pastes used to form the rear electrodes did not contain antimony oxide. Furthermore, in the solar cells of the Examples, there was no generation of beads; and bubbles were not observed in the hot water test. Consequently, it may be seen that the aluminum pastes of the embodiments exhibit characteristics desirable for reducing manufacturing failure.

Further, it may be seen that, for the solar cells of the Examples in which the aluminum pastes used to prepare the rear electrodes contained 0.25 wt %, 0.5 wt %, and 0.75 wt % of the antimony oxide, the photoelectric conversion efficiency was superior (i.e., to that of the solar cells in which the aluminum pastes used to prepare the rear electrode did not contain antimony oxide, e.g., Comparative Examples 1-6).

It may also be seen that when the aluminum pastes used to prepare the rear electrodes contained 1.0 wt % and 1.5 wt % of the antimony oxide, e.g., Comparative Examples 7 and 8, the solar cells exhibited good bowing characteristics, no generation of beads, and good photoelectric conversion efficiency. However, the solar cells of Comparative Examples 7 and 8 exhibited low electrode stability and characteristics that may result in deteriorated reliability of the solar cell modules.

By way of summation and review, in the fabrication of the solar cell, stress resulting from a difference in thermal expansion coefficient between the wafer and the rear electrode upon sintering may cause warping or bending of the wafer, (which is referred to as a bowing phenomenon), or deterioration of photoelectric conversion efficiency.

Furthermore, although a reduction in manufacturing costs of the solar cells may result from a decrease in thickness of the wafer, the bowing phenomenon may become more severe as the wafer decreases in thickness. Thus, the decrease in thickness of the wafer results in product defects and increase in the manufacturing costs of the solar cells.

Accordingly, the embodiments provide an aluminum paste that effectively suppresses the bowing phenomenon. In addition, the embodiments provide an aluminum paste that reduces generation of beads while improving photoelectric conversion efficiency of a solar cell.

Exemplary embodiments have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. An aluminum paste for a rear electrode of a solar cell, the aluminum paste comprising:

aluminum powder;

an organic vehicle; and antimony oxide, the antimony oxide being present in an amount of about 0.001 wt % to about 0.75 wt %, based on a total weight of the aluminum paste.

2. The aluminum paste for a rear electrode of a solar cell as claimed in claim 1, wherein the antimony oxide includes at least one of $Sb_2O_3$, $Sb_2O_4$, and $Sb_2O_5$.

3. The aluminum paste for a rear electrode of a solar cell as claimed in claim 1, wherein the antimony oxide includes antimony oxide powder having an average particle size of about 0.01 μm to about 10 μm.

4. The aluminum paste for a rear electrode of a solar cell as claimed in claim 1, wherein the antimony oxide is in the form of a spherical powder.

5. The aluminum paste for a rear electrode of a solar cell as claimed in claim 1, wherein the aluminum powder is present in an amount of about 60 to about 80 wt %, based on the total weight of the aluminum paste.

6. The aluminum paste for a rear electrode of a solar cell as claimed in claim 1, wherein the aluminum powder has an average particle size of about 0.1 μm to about 10 μm.

7. The aluminum paste for a rear electrode of a solar cell as claimed in claim 1, wherein the organic vehicle is present in an amount of about 0.1 to about 40 wt %, based on the total weight of the aluminum paste.

8. The aluminum paste for a rear electrode of a solar cell as claimed in claim 1, wherein the organic vehicle includes at least one of an acrylic binder resin and a cellulose binder resin.

9. The aluminum paste for a rear electrode of a solar cell as claimed in claim 1, wherein the organic vehicle includes a solvent, the solvent including at least one of hexane, toluene, ethyl cellosolve, cyclo hexanone, butyl cellosolve, butyl carbitol (diethylene glycol monobutyl ether), dibutyl carbitol (diethylene glycol dibutyl ether), butyl carbitol acetate (diethylene glycol monobutyl ether acetate), propylene glycol monomethyl ether, hexane glycol, terpineol, methylethylketone, benzylalcohol, gamma-butyrolactone, and ethyl lactate.

10. The aluminum paste for a rear electrode of a solar cell as claimed in claim 1, further comprising a glass frit.

11. The aluminum paste for a rear electrode of a solar cell as claimed in claim 10, wherein the glass frit is present in an amount of about 0.01 to about 20 wt %, based on the total weight of the aluminum paste.

12. The aluminum paste for a rear electrode of a solar cell as claimed in claim 10, wherein the glass frit includes at least one of zinc oxide-silicon oxide ($ZnO—SiO_2$), zinc oxide-boron oxide-silicon oxide ($ZnO—B_2O_3—SiO_2$), zinc oxide-boron oxide-silicon oxide-aluminum oxide ($ZnO—B_2O_3—SiO_2—Al_2O_3$), bismuth oxide-silicon oxide ($Bi_2O_3—SiO_2$), bismuth oxide-boron oxide-silicon oxide ($Bi_2O_3—B_2O_3—SiO_2$), bismuth oxide-boron oxide-silicon oxide-aluminum oxide ($Bi_2O_3—B_2O_3—SiO_2—Al_2O_3$), bismuth oxide-zinc oxide-boron oxide-silicon oxide ($Bi_2O_3—ZnO—B_2O_3—SiO_2$), and bismuth oxide-zinc oxide-boron oxide-silicon oxide-aluminum oxide ($Bi_2O_3—ZnO—B_2O_3—SiO_2—Al_2O_3$) glass frits.

13. The aluminum paste for a rear electrode of a solar cell as claimed in claim 1, further comprising a dispersant.

14. The aluminum paste for a rear electrode of a solar cell as claimed in claim 13, wherein the dispersant includes at least one of stearic acid, palmitic acid, myristic acid, oleic acid, and lauric acid.

15. A solar cell comprising a rear electrode prepared from the aluminum paste as claimed in claim 1.

16. A solar cell, comprising a rear electrode, the rear electrode including aluminum and antimony oxide.

* * * * *